US008806817B2

(12) United States Patent
Turner et al.

(10) Patent No.: US 8,806,817 B2
(45) Date of Patent: Aug. 19, 2014

(54) STRUCTURAL STRINGER FOR STAIRWAYS

(75) Inventors: Patrick Turner, Sutton (CA); Tyler Sutherland, Cumberland Beach (CA)

(73) Assignee: Case-Modular Stair Systems Inc., Sutton (CA)

( * ) Notice: Subject to any disclaimer, the term of this patent is extended or adjusted under 35 U.S.C. 154(b) by 384 days.

(21) Appl. No.: 12/837,315

(22) Filed: Jul. 15, 2010

(65) Prior Publication Data

US 2012/0011786 A1 Jan. 19, 2012

(51) Int. Cl.
*E04F 11/025* (2006.01)

(52) U.S. Cl.
USPC ..... 52/191; 52/188

(58) Field of Classification Search
CPC ..... E04F 11/025; E04F 2011/0214
USPC ..... 52/182–184, 188, 191
See application file for complete search history.

(56) References Cited

U.S. PATENT DOCUMENTS

| | | | | |
|---|---|---|---|---|
| 3,608,256 | A * | 9/1971 | Jefferys | 52/182 |
| 5,163,491 | A * | 11/1992 | Smith | 144/353 |
| 2003/0093959 | A1* | 5/2003 | Couture | 52/182 |
| 2008/0229686 | A1* | 9/2008 | Raymond | 52/191 |
| 2009/0056245 | A1* | 3/2009 | Miller | 52/188 |
| 2010/0192487 | A1* | 8/2010 | Thornton et al. | 52/183 |
| 2010/0319278 | A1* | 12/2010 | Grenier | 52/182 |

FOREIGN PATENT DOCUMENTS

| | | | |
|---|---|---|---|
| CA | 2149981 | | 11/1995 |
| CA | 2276988 | A1 | 12/1999 |
| WO | 2005090705 | A1 | 9/2005 |
| WO | 2009021321 | A1 | 2/2009 |

* cited by examiner

*Primary Examiner* — Eilzabeth A Plummer
(74) *Attorney, Agent, or Firm* — Caseiro Burke LLC; Chris A. Caseiro

(57) ABSTRACT

A stringer assembly for mounting to steps of a stairway, comprises first and second stringer members. The first stringer member are adapted to be secured to the steps with first fasteners that are driven through the first stringer member and then into the steps. The second stringer member is adapted to be positioned with respect to the first stringer member such as to conceal the first fastener and to be mounted thereto via second fasteners and glue, wherein the second fasteners are adapted to be driven through the first stringer member and then into the second stringer member. Decorative covers are provided for mounting onto exposed edges of the first and second stringer members. A method for assembling a stringer to steps of a stairway and a kit for producing a stringer assembly for use in stairways are also disclosed.

20 Claims, 7 Drawing Sheets

STRUCTURAL STRINGER FOR STAIRWAYS

CROSS REFERENCE TO RELATED APPLICATIONS

N/A

FIELD OF THE INVENTION

The present invention relates to stairways and, more particularly, to stringers for use generally in modular stairways made of pre-fabricated components such as stringers, step supports, railings, etc., typically in the form of a kit for assembly on site.

BACKGROUND OF THE INVENTION

Typically, staircases are completely produced on site with the various wood components being cut to size as the staircase is progressively erected on site.

Also, it has been proposed to completely assemble a staircase in the factory such that a pre-assembled staircase is delivered to the construction site for direct and easy installation thereat. Such a modular staircase is disclosed in the Canadian Application No. 2,149,981 naming Raymond Couture as inventor and laid-open for public inspection on Nov. 24, 1995.

In Canadian Application No. 2,276,988 also naming Raymond Couture as inventor and laid-open for public inspection on Dec. 30, 1999, a modular staircase is proposed that includes a permanent framing made of metallic stringers and vertically extending step supports that are secured along the stringers. Each step support includes upper and front flanges adapted to be secured respectively to a tread and to a riser of each step of the staircase. If the staircase has a partly exposed side, various decorative or finishing wooden components, including treads, risers, false or decorative stringers, mouldings, etc., are provided to cover any exposed structural metallic framework and particularly the stringers.

Furthermore, PCT Patent Publication No. WO 2005/090705-A1 published on Sep. 29, 2005 in the name of Raymond Couture, discloses staircases that are constructed of modular stringers for the on-site installation of the staircases in a residential, commercial or industrial setting. Kits for erecting the staircases include matingly or cooperatively coupling step support units defining the staircase stringers, a set of steps adapted to be mounted thereon, as well as various finishing elements and modules to provide a finished look to the completed staircases. The staircases include self-supporting staircases, linear staircases, curling or spiralling staircases and adjustable variations thereof.

Finally, PCT Patent Publication No. WO 2009/021321-A1 published on Feb. 19, 2009 in the name of Case-Modular Stair Systems Inc., discloses a stairway system, kit and method for assembling the kit. The system includes pre-fabricated components such as steps, stringers, decorative mouldings and panels or boards, etc. The kit comprises a step module and an adjacent step module, the step module comprising a riser and a tread, the riser being adapted to abut the tread on a first side thereof and being adapted to define a fastener-mating portion on a second side thereof. The tread is adapted to be secured atop the riser on one side thereof. The adjacent step module comprises a riser and a tread, the adjacent step module being adapted to be assembled with the step module by engaging a fastener with the fastener-mating portion of the step module and securing the fastener to the tread of the adjacent step module to secure the two step modules together. A stringer is adapted to be disposed on a wall where the step module is adjacent to the wall. Also, a finishing board is provided for mounting on the exposed side of the stairway.

In spite of these various devices, there remains a need for a structural stringer having an aesthetic look, when exposed, typically for use in a modular stairway system, generally in the form of a kit, which can be assembled to erect a stairway on site.

SUMMARY OF THE INVENTION

It is therefore an aim of the present invention to provide a novel stringer for use on a stairway.

It is also an aim of the present invention to provide a novel stringer that is both structural and aesthetic, for use in a stairway system in the form of a kit.

It is a further aim of the present invention to provide a novel stringer that is both structural and aesthetic, for use of an exposed side of a stairway.

Therefore, in accordance with the present invention, there is provided a stringer assembly for use in stairways, comprising first and second stringer members, the first stringer member being adapted to be secured to at least one step of the stairway with at least one first fastener adapted to be driven through the first stringer member and then into the step, the second stringer member being adapted to be positioned with respect to the first stringer member such as to conceal the first fastener.

Also in accordance with the present invention, there is provided a kit for producing a stringer assembly for use in stairways, comprising first and second stringer members, the first stringer member being adapted to be secured to at least one step of the stairway with at least one first fastener adapted to be driven through the first stringer member and then into the step, the second stringer member being adapted to be positioned with respect to the first stringer member such as to conceal the first fastener.

Further in accordance with the present invention, there is provided a method for assembling a stringer to steps of a stairway comprising:

(a) providing first and second stringer members;

(b) mounting the first stringer member to the steps with first fasteners, the first fasteners being driven through the first stringer member and then into the steps;

(c) positioning the second stringer member with respect to the first stringer member such as to conceal the first fasteners; and (d) mounting the second stringer member to the first stringer member with second fasteners, the second fasteners being driven through the first stringer member and then into the second stringer member.

Other objects, advantages and features of the present invention will become more apparent upon reading of the following non-restrictive description of embodiments thereof, given by way of example only with reference to the accompanying drawings.

BRIEF DESCRIPTION OF THE DRAWINGS

Reference will now be made to the accompanying drawings, showing by way of illustration an illustrative embodiment of the present invention, and in which.

DESCRIPTION OF ILLUSTRATIVE EMBODIMENTS OF THE INVENTION

Turning to the Figures of the appended drawings, there is shown a stringer assembly S in accordance with the present invention. The stringer assembly S is illustrated in combination with a series of steps 10 (each made of a tread 10*a* and a riser 10*b*) so that when the stringer assembly S and steps 10 are assembled, a stairway is produced. The stringer assembly S, which is made of a series of components (as detailed hereinafter), is shown in an assembled state thereof in FIG. 5.

Figure 1:
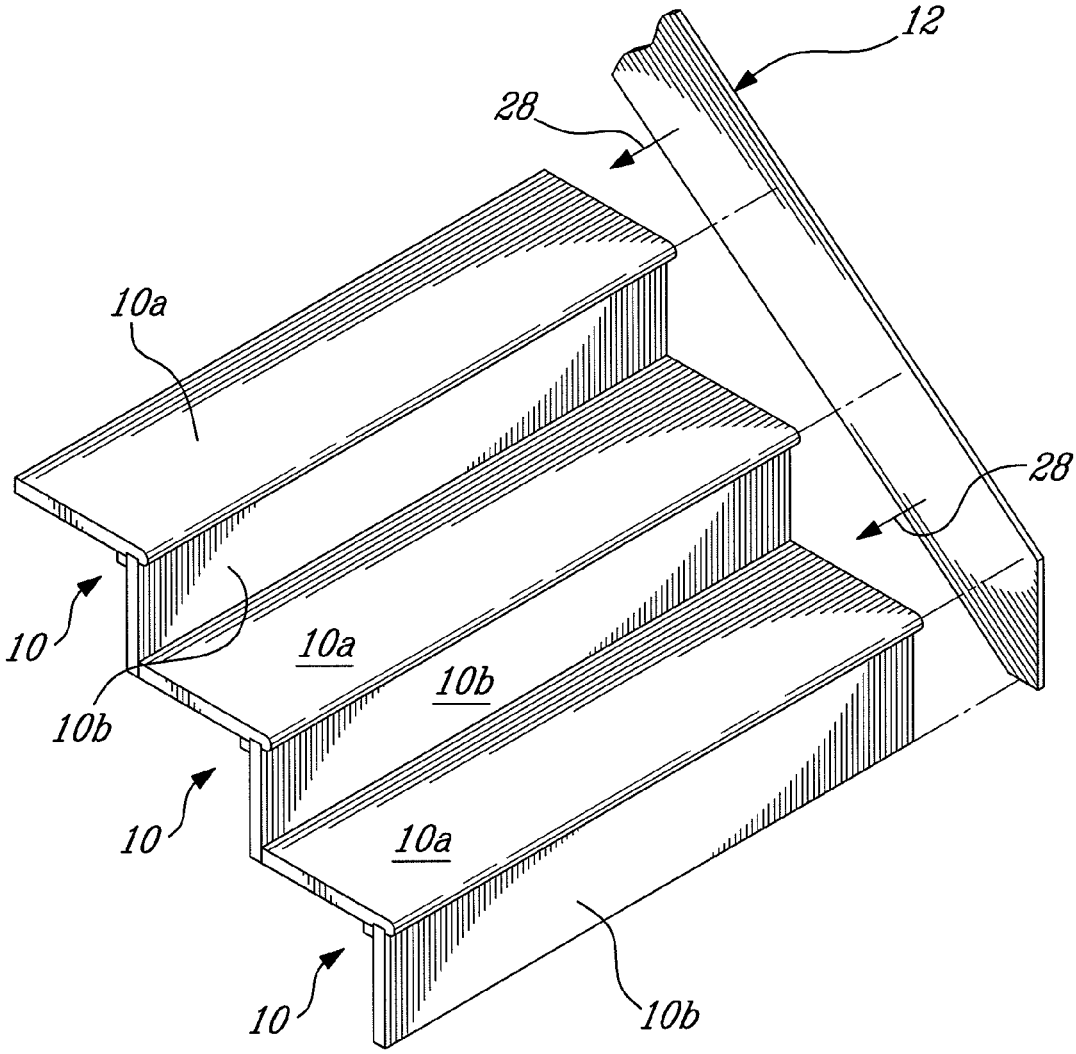
FIG. 1 is an exploded perspective view of part of a stairway, showing an inside stringer member of a stringer assembly in accordance with an illustrative embodiment of the present invention, the inside stringer member being shown in the process of being installed onto a series of steps of the stairway.
Figure 2:
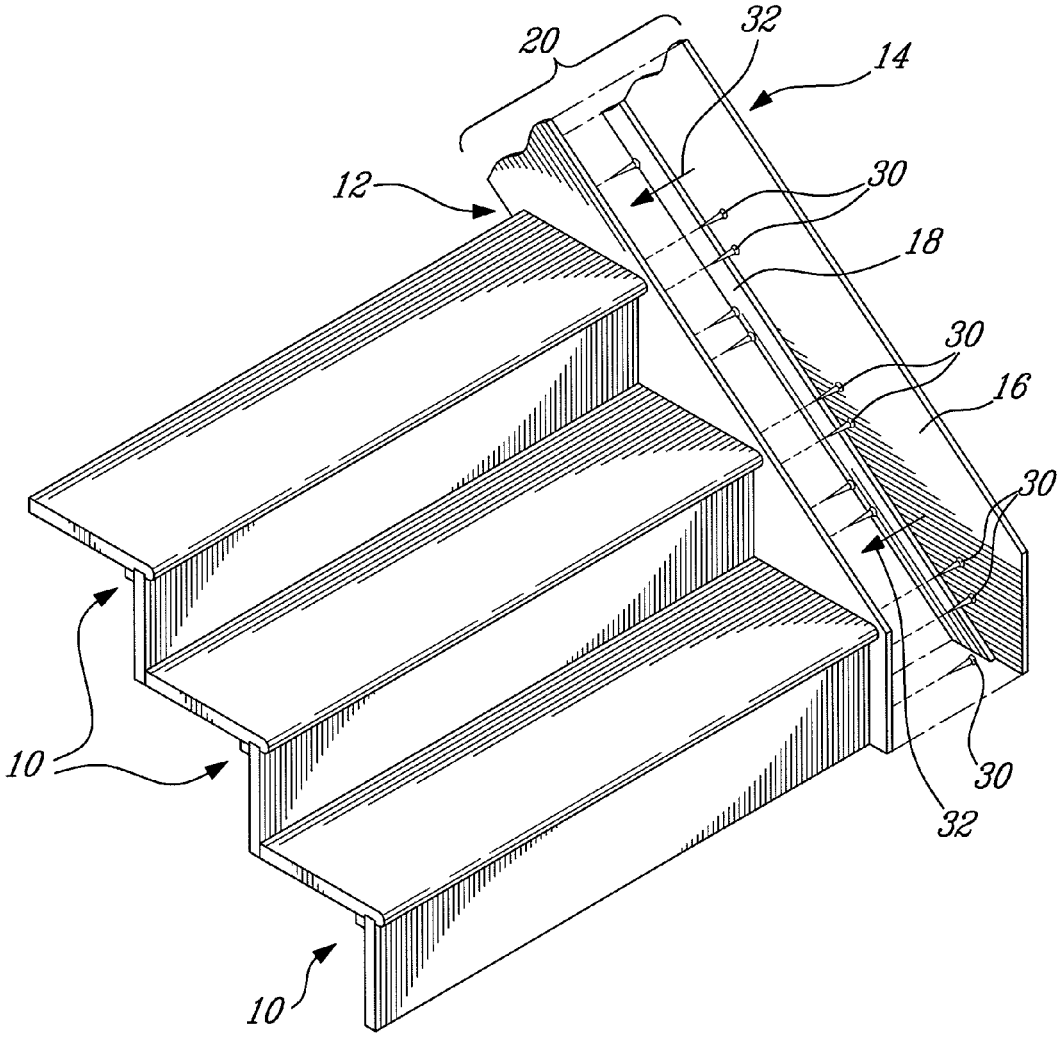
FIG. 2 is an exploded perspective view showing an outside stringer member of the stringer assembly of the present invention, the outside stringer member being shown in the process of being installed on the inside stringer member.

As seen for instance in FIGS. 1 and 2, the stringer assembly S includes an inner stringer member 12 and an outer stringer member 14. The inner stringer member 12 has the form of an elongated panel, which has for instance a thickness of 0.75 inch and which can be made of various materials, such as hardwood, plywood (with, for instance, an aesthetic veneer on the surfaces that will be exposed once the stringer assembly S has been installed), etc.

Figure 7:
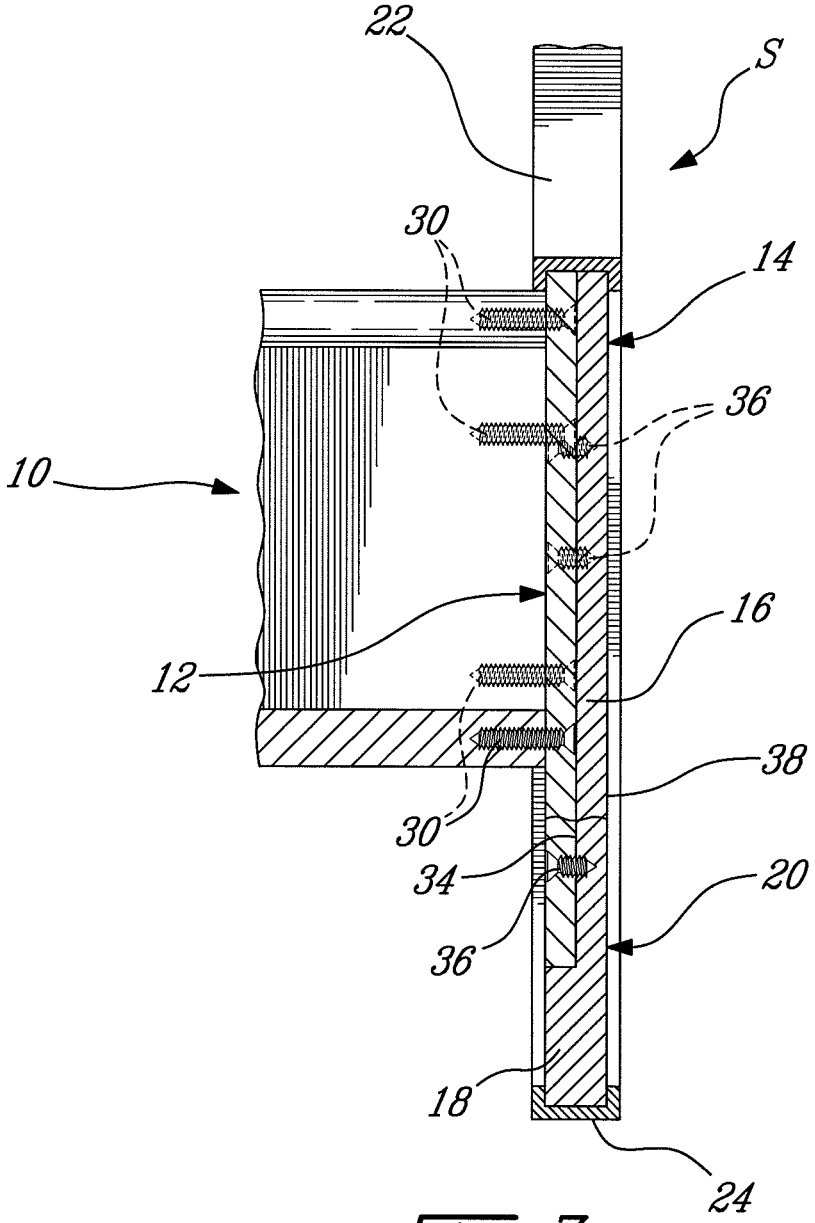
FIG. 7 is a cross-sectional view taken along line 7-7 of FIG. 6.

The outer stringer member 14 includes a panel section 16 and a support section 18 extending along a lower end of the panel section 16. The panel section 16 has the form of an elongated panel, which has for instance a thickness of 0.75 inch and which can be made of various materials, such as hardwood, plywood (with, for instance, an aesthetic veneer on the surfaces that will be exposed once the stringer assembly S has been installed), etc. The support section 18 typically has the same thickness as the inner stringer member 12, as when the inner and outer stringer members 12 and 14 are assembled together, the inner stringer member 12 extends atop the support section 18 of the outer stringer member 14, as best seen in FIG. 7. The inner and outer stringer members 12 and 14 when assembled produce a structural stringer 20 having for instance a thickness of 1.5 inch.

The inner and outer stringer members 12 and 14 are basically provided with aesthetic finishes at least on the surfaces thereof that will be exposed once the stringer assembly S has been installed.

Figure 4:
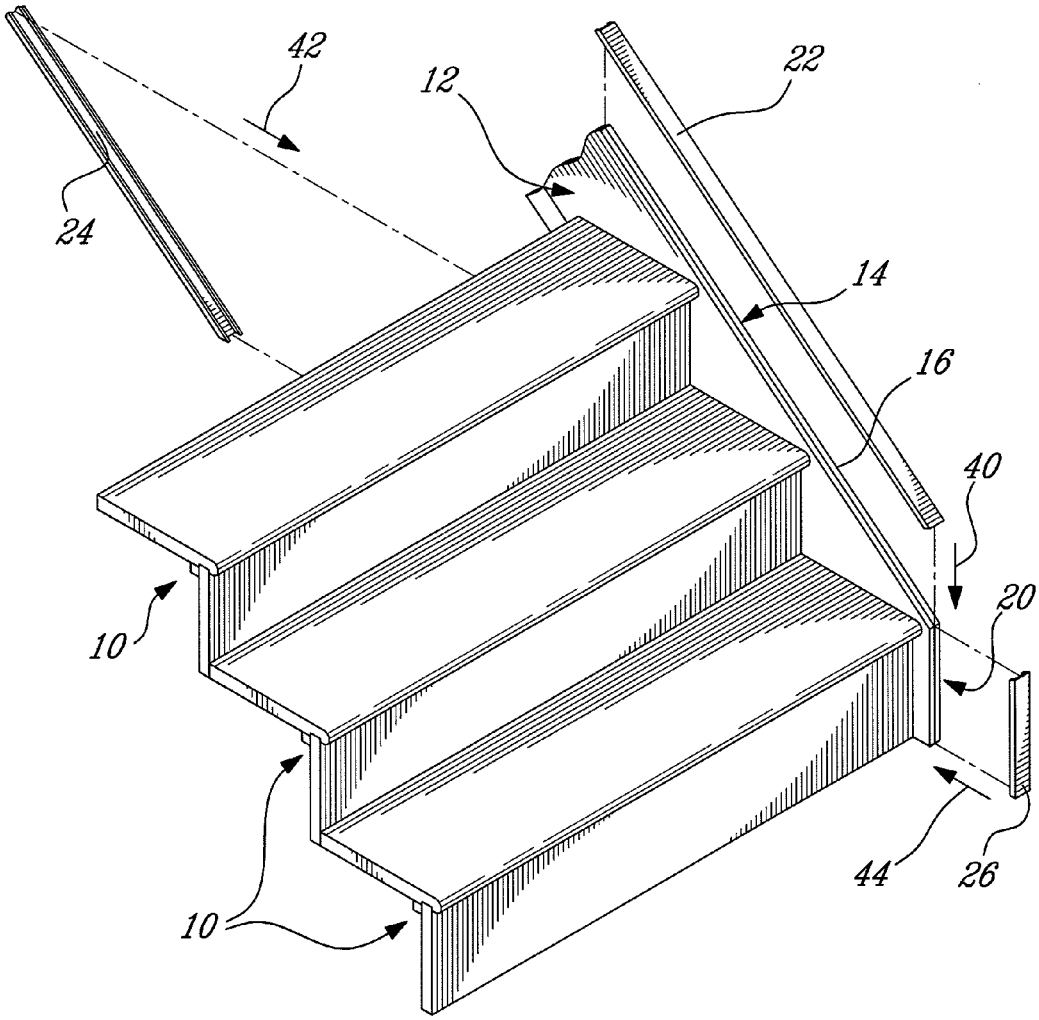
FIG. 4 is an exploded perspective view showing trimmings of the stringer assembly of the present invention, in the process of being installed on the assembled inside and outside stringer members.

As illustrated in FIG. 4, the stringer assembly S is provided with various trimmings, which are adapted to be installed on the structural stringer 20, i.e. on the assembled inner and outer stringer members 12 and 14. These trimmings include upper, lower and front caps 22, 24 and 26, respectively, and have aesthetic finishes at least on the surfaces thereof that will be exposed once the stringer assembly S has been installed.

The upper and lower caps 22 and 24 are elongated and are typically made of hardwood for decorative purposes, although other wood-based or non-wooden materials can be contemplated. The upper and lower caps 22 and 24 each have a C-shaped cross-section and are adapted to be mounted along the upper and lower ends of the stringer 20.

The front cap 26 is elongated and typically made of hardwood for decorative purposes, although other wood-based or non-wooden materials can be contemplated. The front cap 26 has a C-shaped cross-section and is adapted to be mounted along the front end of the stringer 20.

The stringer assembly S is assembled together and mounted to the steps 10 as follows. Typically, the stringer assembly S is used for mounting on an exposed side of the stairway when the stairway extends along a wall, the exposed side being opposite the side of the stairway abutting the wall. The stringer assembly S can also be used on both sides of the stairway when both sides are exposed.

Figure 6:
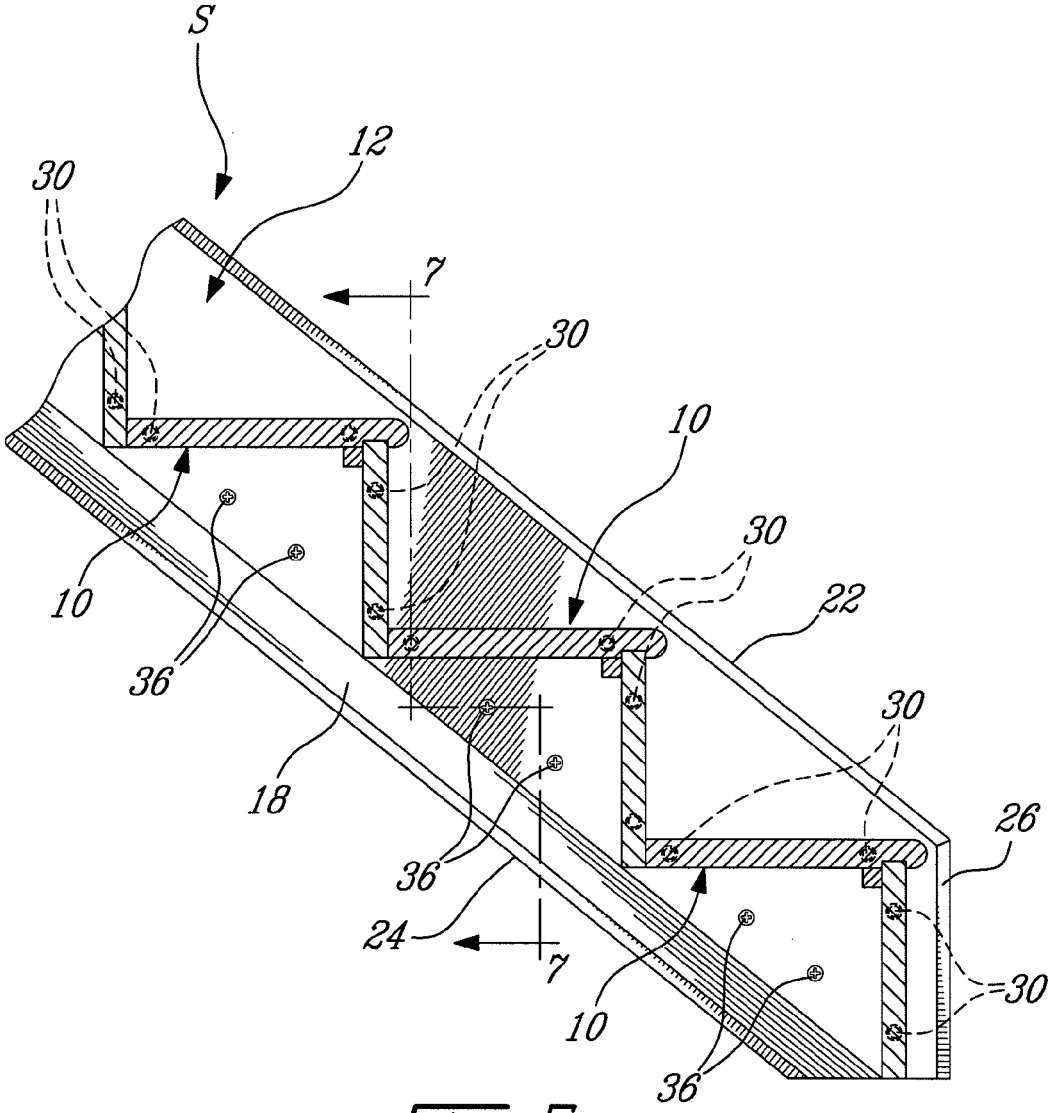
FIG. 6 is a cross-sectional view taken along line 6-6 of FIG. 5.

With reference to FIGS. 1 and 2, the inner stringer member 12 is brought along arrows 28 against the assembled steps 10 and is secured thereto for instance with screws 30 (and/or nails, and/or other appropriate fasteners, including glues), which are driven from the exposed side of the inner stringer member 12, through the inner stringer member 12 and into the steps 10. The installed screws 30 can be seen in FIGS. 3, 6 and 7.

Figure 3:
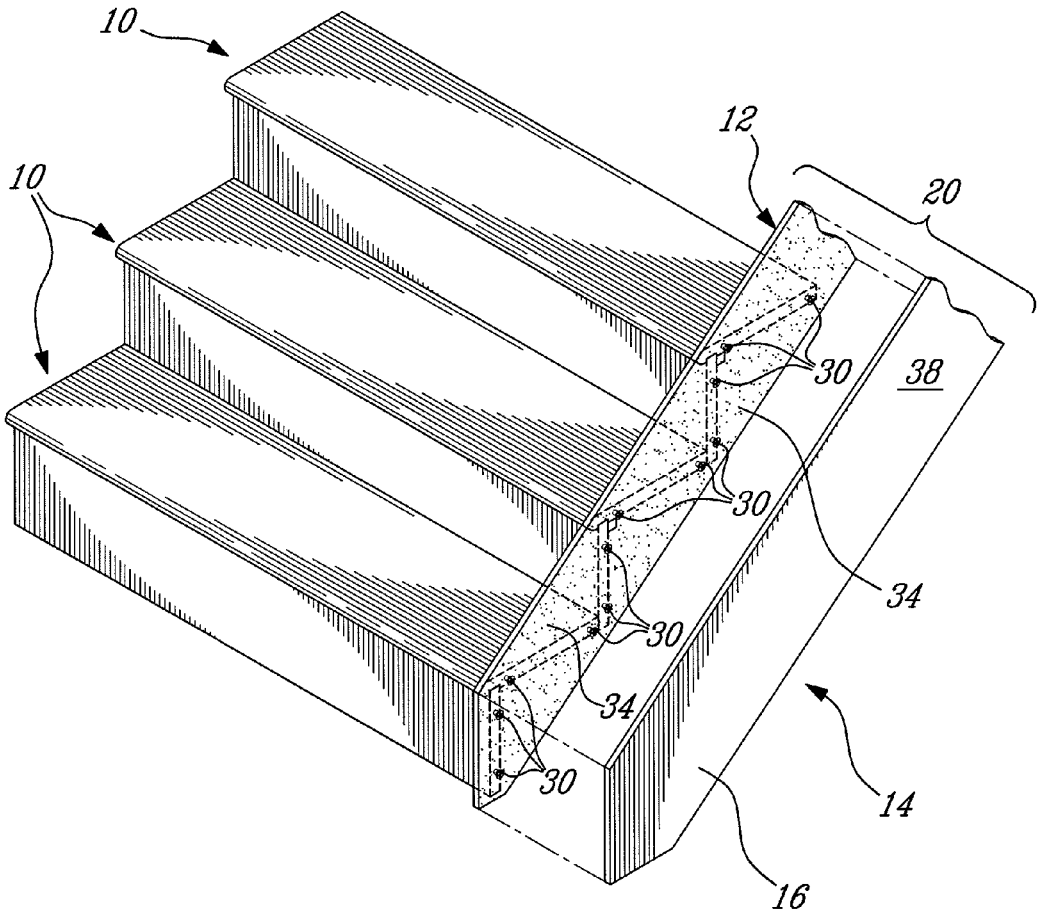
FIG. 3 is an exploded perspective view, taken from another side than FIG. 2, further showing the outside stringer member in the process of being installed on the inside stringer member.

Now referring to FIGS. 2 and 3, the outer stringer member 14 is brought along arrows 32 against the inner stringer member 12, such that the inner stringer member 12 sits atop the support section 18 of the outer stringer member 14 (see FIG. 7). Typically, glue is applied so that the inner and outer stringer members 12 and 14 become adhered together. In the illustrated embodiment, glue 34 has been applied on the inner stringer member 12, as shown in FIG. 3, before the outer stringer member 14 is brought against the inner stringer member 12.

Thereafter, the inner and outer stringer members 12 and 14 are further secured together using for instance screws 36 (and/or nails, and/or other appropriate fasteners), which are driven from the inner side of the inner stringer member 12 outwardly through the inner stringer member 12 and into the outer stringer member 14. The installed screws 36 can be seen in FIGS. 6 and 7. The length of the screws 36 is less than the thickness of the stringer 20 such that the screws 36 do not extend past a visible outer surface 38 of the outer stringer member 14.

Figure 5:
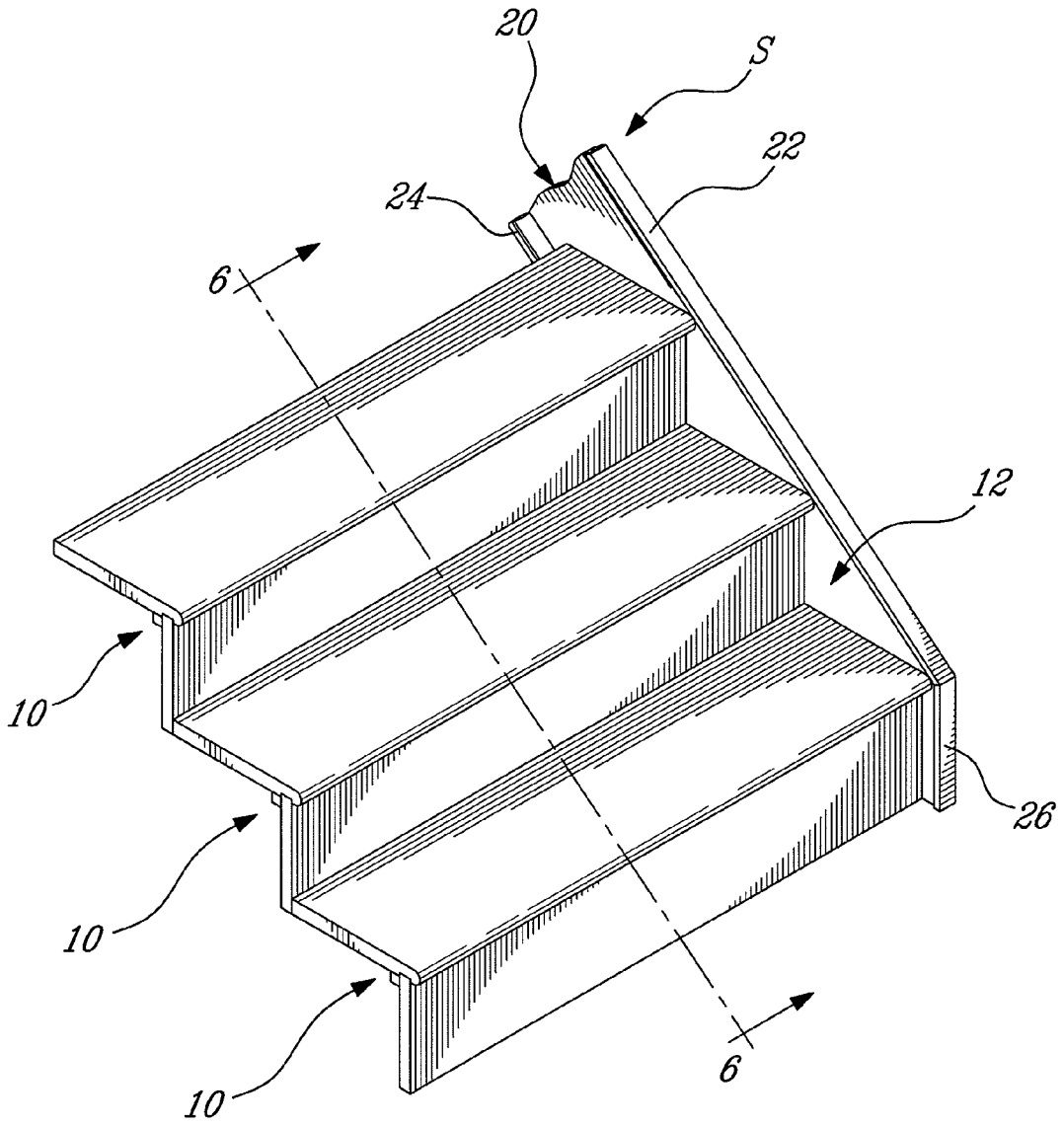
FIG. 5 is a perspective view of the stringer assembly of the present invention assembled to the series of steps of the stairway.

Then, the upper, lower and front caps 22, 24 and 26 are mounted, typically with glue for a clean finish, respectively to the upper, lower and front ends of the stringer 20. FIG. 4 illustrates the upper, lower and front caps 22, 24 and 26 being brought against the stringer 20 as per arrows 40, 42 and 44, respectively. FIG. 5 shows the resulting assembly of the upper, lower and front caps 22, 24 and 26 with the stringer 20 thereby forming the stringer assembly S.

From the above and the drawings, it is clear that the present stringer assembly S provides a structural stringer for a stairway, the stringer assembly S being adapted to provide the required support for the steps 10 of the stairway. Furthermore, the exposed portions of the stringer assembly S do not show any fastener and there id no need to apply finishing putty to cover fasteners or holes produced by fasteners. The stringer assembly S thus provides a clean finish.

Although the present invention has been described hereinabove by way of embodiments thereof, it may be modified, without departing from the nature and teachings of the subject invention as described herein.

The invention claimed is:

1. A stringer assembly for use in stairways, comprising:

a first stringer member in the form of an elongated single piece panel having one lateral flat surface for being positioned on a lateral side of a previously assembled stairway along the length thereof and an opposite lateral flat surface, the first stringer member being adapted to be secured to at least one step of the stairway with at least one first fastener adapted to be driven through the first stringer member from the opposite lateral flat surface thereof and then into the step; and a second stringer member in the form of an elongated single piece panel having one lateral flat surface thereof for being positioned on the opposite lateral flat surface of the first stringer member along the length and the width thereof such as to conceal the first fastener, the second stringer member being adapted to be mounted to the first stringer member, the second stringer member including a support section extending beneath the one lateral flat surface thereof and defining a flat support edge that is perpendicular to the one lateral flat surface, the first stringer member defining a bottom flat edge adapted to be directly mounted on the support edge along the length thereof, the support section having a thickness at least equal to the thickness of the first stringer member, wherein the first and second stringer members when assembled together form a stringer.

2. A stringer assembly as defined in claim 1, wherein the second stringer member is adapted to be mounted to the first stringer member via at least one of a second fastener and glue.

3. A stringer assembly as defined in claim 2, wherein the second fastener is adapted to be driven through the first stringer member and then into the second stringer member.

4. A stringer assembly as defined in claim 1, wherein decorative covers are provided for mounting onto exposed edges of the stringer.

5. A stringer assembly as defined in claim 4, wherein the decorative covers are elongated and C-shaped, the decorative covers being adapted to be glued to the stringer.

6. A stringer assembly as defined in claim 1, wherein the second stringer member includes a support section extending beneath the one lateral flat surface thereof and defining a support edge the first stringer member defining a bottom edge adapted to overlie the support edge along the length thereof.

7. A stringer assembly as defined in claim 6, wherein glue is provided between the facing lateral surfaces of the first stringer member and the second stringer member.

8. A stringer assembly as defined in claim 7, wherein the glue is also provided between the facing bottom edge of the first stringer member and the support edge of the second stringer member.

9. A kit for producing a stringer assembly for use in stairways, comprising:

a first stringer member in the form of an elongated single piece panel having one lateral flat surface for being positioned on a lateral side of a previously assembled stairway along the length thereof and an opposite lateral flat surface, the first stringer member being adapted to be secured to at least one step of the stairway with at least one first fastener adapted to be driven through the first stringer member from the opposite lateral flat surface thereof and then into the step; and a second stringer member in the form of an elongated single piece panel having one lateral flat surface thereof for being positioned on the opposite lateral flat surface of the first stringer member along the length and the width thereof such as to conceal the first fastener, the second stringer member being adapted to be mounted to the first stringer member, the second stringer member including a support section extending beneath the one lateral flat surface thereof and defining a flat support edge that is perpendicular to the one lateral flat surface, the first stringer member defining a bottom flat edge adapted to be directly mounted on the support edge along the length thereof, the support section having a thickness at least equal to the thickness of the first stringer member, wherein the first and second stringer when assembled together form a stringer.

10. A kit as defined in claim 9, further comprising at least one of a second fastener and glue, wherein the second stringer member is adapted to be mounted to the first stringer member via at least one of the second fastener and the glue.

11. A kit as defined in claim 10, wherein the second fastener is adapted to be driven through the first stringer member and then into the second stringer member.

12. A kit as defined in claim 9, further comprising decorative covers and glue, the decorative covers being adapted to be mounted onto exposed edges of the stringer with the glue.

13. A kit as defined in claim 12, wherein the decorative covers are elongated and C-shaped.

14. A kit as defined in claim 9, wherein the second stringer member includes a support section extending beneath the one lateral flat surface thereof and defining a support edge, the first stringer member defining a bottom edge adapted to overlie the support edge along the length thereof.

15. A kit as defined in claim 14, further comprising glue for gluing together the facing lateral surfaces of the first stringer member and the second stringer member, and for gluing together the facing bottom edge of the first stringer member and the support edge of the second stringer member.

16. A method for assembling a stringer to steps of a stairway comprising:

(a) providing first and second stringer members, the first stringer being in the form of an elongated single piece panel having one lateral flat surface and an opposite lateral flat surface, the second stringer member being in the form of an elongated single piece panel having one lateral flat surface thereof, the second stringer member including a support section extending beneath the one lateral flat surface thereof and defining a flat support edge that is perpendicular to the one lateral flat surface, the first stringer member defining a bottom flat edge adapted to be directly mounted on the support edge along the length thereof, the support section having a thickness at least equal to the thickness of the first stringer member;

(b) mounting the one lateral flat surface of the first stringer member to the steps with first fasteners, the first fasteners being driven through the first stringer member and then into the steps;

(c) positioning the one lateral flat surface of the second stringer member to the one lateral flat surface of the first stringer member such as to conceal the first fasteners; and (d) mounting the second stringer member to the first stringer member with second fasteners, the second fasteners being driven through the first stringer member and then into the second stringer member.

17. The method of claim 16, further comprising a step (e), wherein in step (e), decorative covers are mounted onto exposed edges of the first and second stringer members.

18. The method of claim 17, wherein in step (e), the decorative covers are glued to the exposed edges of the first and second stringer members.

19. The method of claim 16, wherein before step (c), glue is provided on at least one of facing surfaces of the first and second stringer members so as to attach together the first and second stringer members before the second fasteners are used in step (d) to further secure together the first and second stringer members.

20. The method of claim 19, wherein the second stringer member includes a support section extending beneath the one lateral flat surface thereof and defining a support edge, the first stringer member defining a bottom edge, the bottom edge in step (c) overlying the support edge along the length thereof wherein the glue is provided at least between facing surfaces of the first stringer member and the panel section of the second stringer member.

* * * * *